United States Patent [19]

Michaels

[11] Patent Number: 4,472,012

[45] Date of Patent: Sep. 18, 1984

[54] MODULARIZED UNIVERSAL PIN AND SLEEVE ELECTRICAL CONNECTOR

[75] Inventor: Leonard H. Michaels, Warrenville, Ill.

[73] Assignee: Molex Incorporated, Lisle, Ill.

[21] Appl. No.: 474,421

[22] Filed: Mar. 14, 1983

Related U.S. Application Data

[63] Continuation of Ser. No. 240,605, Mar. 4, 1981, abandoned.

[51] Int. Cl.[3] ..... H01R 13/424; H01R 13/59; H01R 13/639

[52] U.S. Cl. ..... 339/63 M; 339/60 M; 339/91 B; 339/103 R

[58] Field of Search ..... 339/14, 59–63, 339/94, 96, 103, 104, 186, 217 S, 91 B

[56] References Cited

U.S. PATENT DOCUMENTS

| | | | |
|---|---|---|---|
| 1,978,510 | 10/1934 | Spence, Jr. | 339/36 |
| 2,428,214 | 9/1947 | Gorey | 339/91 B |
| 2,563,762 | 8/1951 | Uline et al. | 339/63 M |
| 2,703,870 | 2/1954 | Minto | 339/94 |
| 2,999,221 | 9/1961 | Ellis et al. | 339/176 |
| 3,029,407 | 4/1962 | Burton et al. | 339/60 |
| 3,046,512 | 7/1962 | Remke et al. | 339/14 R |
| 3,097,033 | 7/1963 | Felts | 339/75 |
| 3,477,061 | 11/1969 | Stephenson | 339/59 M |
| 3,621,413 | 11/1971 | Hilbert | 339/103 B |
| 3,646,495 | 2/1972 | Cowmeadow | 339/14 R |
| 3,739,076 | 6/1973 | Schwartz | 339/94 R |
| 3,941,444 | 3/1976 | Bruni et al. | 339/94 M |
| 3,964,771 | 6/1976 | Baudouin | 285/315 |
| 3,970,352 | 7/1976 | Dorrell et al. | 339/59 M |
| 4,193,655 | 3/1980 | Herrmann Jr. | 339/59 M |

FOREIGN PATENT DOCUMENTS

| | | | |
|---|---|---|---|
| 555470 | 6/1977 | U.S.S.R. | 339/96 |

OTHER PUBLICATIONS

Brad Harrison, General Purpose Control Connectors Catalog, GPC-1 and GPC-4.

Amphenol Low Cost Environmental Connectors Catalog (44 Series), 3-1978.

Amphenol Drawing of Version of MIL-C-26482 (Mil Spec No. 02660).

Cannon ITT, Cannon Standard Line Connectors Catalog, Cover and p. 89, 1980-1981 Edition.

*Primary Examiner*—Neil Abrams

*Attorney, Agent, or Firm*—Louis A. Hecht

[57] ABSTRACT

A modularized pin and sleeve type electrical connector for both portable and stationary industrial applications, the connector having an interfitting plug shell and receptacle shell, male and female inserts which can be interchangeably used therewith, and assorted backshell components. Diaphragms formed across the terminal cavities carried by the inserts act to seal off the cavities, both before and after being pierced by terminals inserted therein. The inserts are multipiece and have conical locking structure formed about the terminal cavities which provide low insertion and high withdrawal forces to the terminals inserted therein. Both the interchangeable inserts as well as the plug and receptacle shells have keying components which permit the inserts to be rotatably positioned in the shells as the connector is assembled in the field, to result in a desired angular mating orientation for the connector. Each of the various backshell components operates to compress the associated insert into its mating shell thereby effecting a proper environmental seal of the insert and terminals. The backshell components for either portable or stationary applications will fit both the plug shell and the receptacle shell.

5 Claims, 10 Drawing Figures

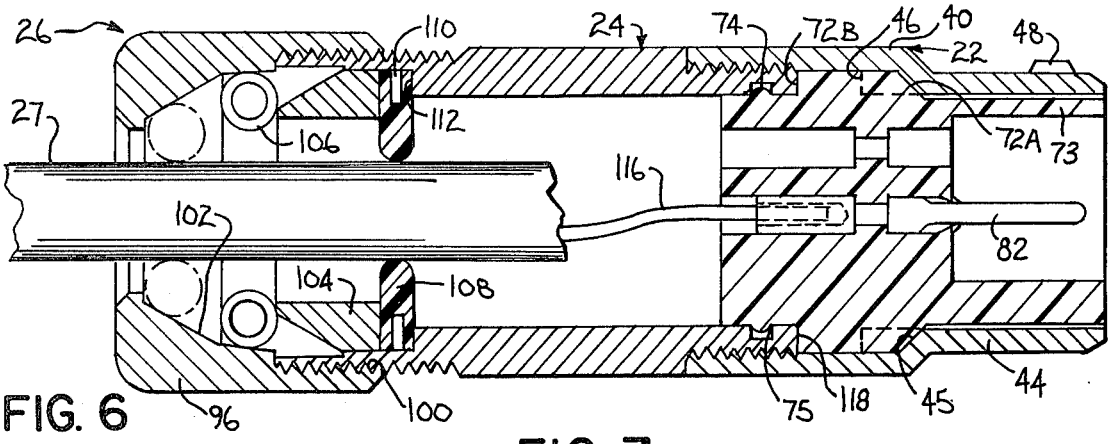
FIG. 6
FIG. 7
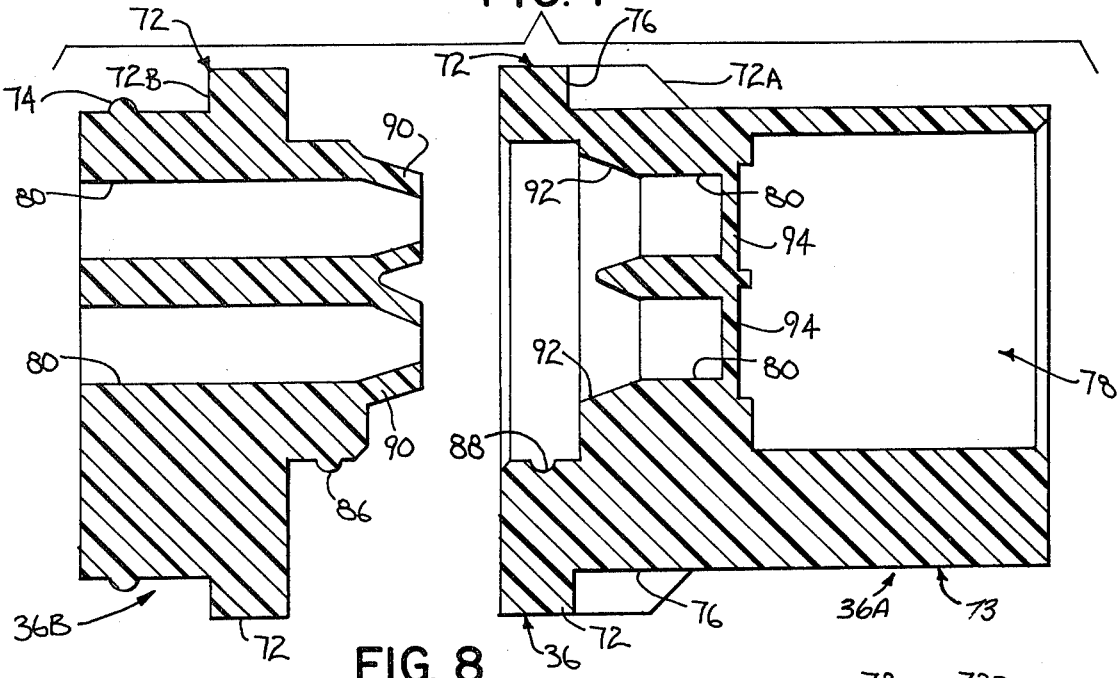
FIG. 8
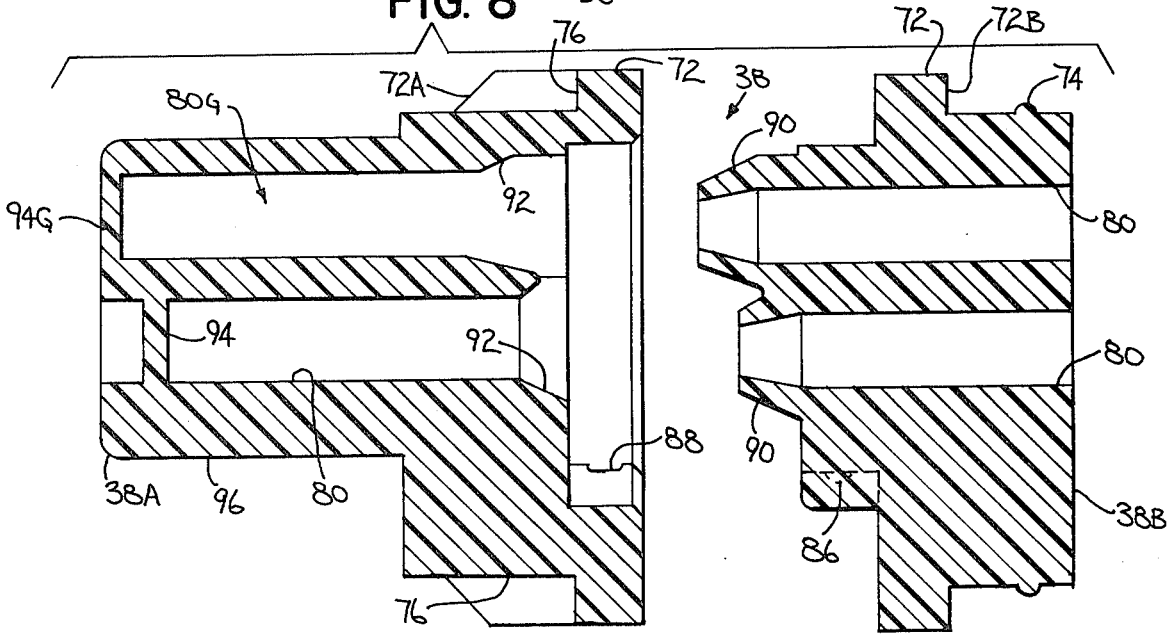

MODULARIZED UNIVERSAL PIN AND SLEEVE ELECTRICAL CONNECTOR

This application is a continuation, of application Ser. No. 06/240,605, filed Mar. 4, 1981, now abandoned.

BACKGROUND OF THE INVENTION

1. Field of the Invention

This invention relates to electrical connectors, and more particularly to a modularized pin and sleeve type electrical connector.

2. Description of Prior Art

Although it depends upon the requirements of the particular application at hand, an electrical connector for industrial use should have several attributes, namely, the desired mounting configuration, the capability of a number of different circuits, a method of positive keying to insure the matability of only specific connector pairs, and the ability to provide strain relief for properly sized cable or wire. Also, the connector should have the ability to allow either the male or female half, or both in the case of a cable-to-cable connection, to be portable. The opposite half would then be mountable to a stationary service box or piece of electrical equipment. Further, electrical connectors which are used in industrial environments must provide reliable performance under specified conditions of mechanical abuse, shock, chemical and moisture contamination, and frequent use. Moreover, they should be easy and foolproof to use and to service. It would also be highly desirable for an industrial connector to be universal in application, that is, capable of meeting several of the different application requirements noted above thereby permitting minimal inventories and eliminating the substantial delays commonly encountered when ordering specialized connectors for specific applications.

Many connectors found in the prior art satisfy some of the above requirements of an industrial connector. In fact, many connectors designed originally for military applications far exceed the technical performance requirements of an industrial connector. However, most such connectors are expensive, highly specialized, and allow little or no option to meet the variable specific requirements encountered with industrial applications. Further, there is little commonality of parts with such prior art connectors nor flexibility in how they can be used. Also, few prior art connectors are capable of easily being used with a lesser number of circuits than provided for by their design while still providing an environmental seal.

Because most prior art connectors which may be attached in the field are usually fixed at the point of manufacture as to the number of circuits, mounting, keying, and other such variables, a specific connector must usually be ordered to meet the requirements of a specific application. Thus, unless the right version of connector is available at the point of use or a nearby point of supply, that meets the immediate need, delays are inevitable.

SUMMARY OF THE INVENTION

The present invention addresses the above-noted prior art problems. Through the use of basic modularized components, the universal connector disclosed herein allows considerable interchanging of parts, i.e., a connector can be custom assembled to meet the specific requirements at hand. This permits the user to construct a large variety of different types of industrial connectors in the field from a minimum number of components in inventory. Further, the components of the present invention are so configured as to provide a high level of performance at an economical cost.

The preferred embodiment of the present electrical connector concerns a five circuit industrial connector of a fixed diameter for wire gauges varying, for example, from #16 AWG (American Wire Gauge) to #20 AWG. It will be understood, however, that the basic modularized connector disclosed herein can cover several sizes of connectors, each size accommodating several smaller gauges or fewer large gauge wires. It is also possible with the present invention to provide a composite connector having a varied array of terminal cavities which are capable of taking a mix of both large and small sized wires.

The present modularized connector includes several basic components, namely, a receptacle shell; a mating plug shell; two-piece male and female inserts which are made from a soft elastomer, are interchangeably compatible with both the plug and receptacle shells, and will accept both male and female terminals; and various backshell components which also are interchangeably compatible with both the plug and receptacle shells. Each of the interchangeable male and female inserts have a plurality of slotted keyways which cooperate with mating keys on the internal diameters of the plug and receptacle shells. This rotatable keying feature, along with the "D"-shaped perimeter configuration of the male and female inserts, allows the user to custom assemble a connector having a desired, pre-selected angular mating orientation without additional or special parts. The terminal cavities formed in each of the inserts contain diaphragms which act to seal off each cavity until used, that is, until intentionally pierced by a terminal or sharp-pointed tool. The two-piece elastomeric inserts also have conical locking components which provide low insertion forces and high withdrawal forces to the terminals, yet which allow for easy removal and replacement of a damaged terminal. Also disclosed is a garter spring type of strain relief mechanism, i.e. a cord grip, for when the connector is used with portable cables, which prevents strain from occurring at the wire termination.

Thus, it is a primary object of the present invention to provide a universal electrical connector having a minimum number of basic components from which a wide variety of specific connectors can be custom assembled.

It is another object to provide a universal connector having modularized components which are fully interchangeable.

It is a further object to provide an electrical connector having male and female inserts which can be rotatably indexed to a pre-selected angular mating orientation during assembly in the field, thus uniquely keying specific connector pairs to mate only with themselves.

It is yet another object to provide an electrical connector having two-piece male and female inserts which are capable of surviving high unintentional withdrawal forces on the terminals placed therein, while still providing low insertion forces and easy removal of the terminal when required.

The means by which the foregoing and other objects of the present invention are accomplished and the manner of their accomplishment will be readily understood from the following specification upon reference to the accompanying drawings, in which:

FIG. 6 is a cross section of the plug shell, backshell, and strain relief adapter components of the connector of FIG. 1, as viewed along lines 6—6 thereof;

FIG. 7 is an enlarged and exploded cross-sectional view of the male insert, as viewed along lines 7—7 of FIG. 4;

FIG. 8 is a cross-sectional view of the female insert, similar to FIG. 7, but taken along lines 8—8 of FIG. 3;

DESCRIPTION OF THE PREFERRED EMBODIMENT

Figures 1, 2, 3, 4, 5, 10:
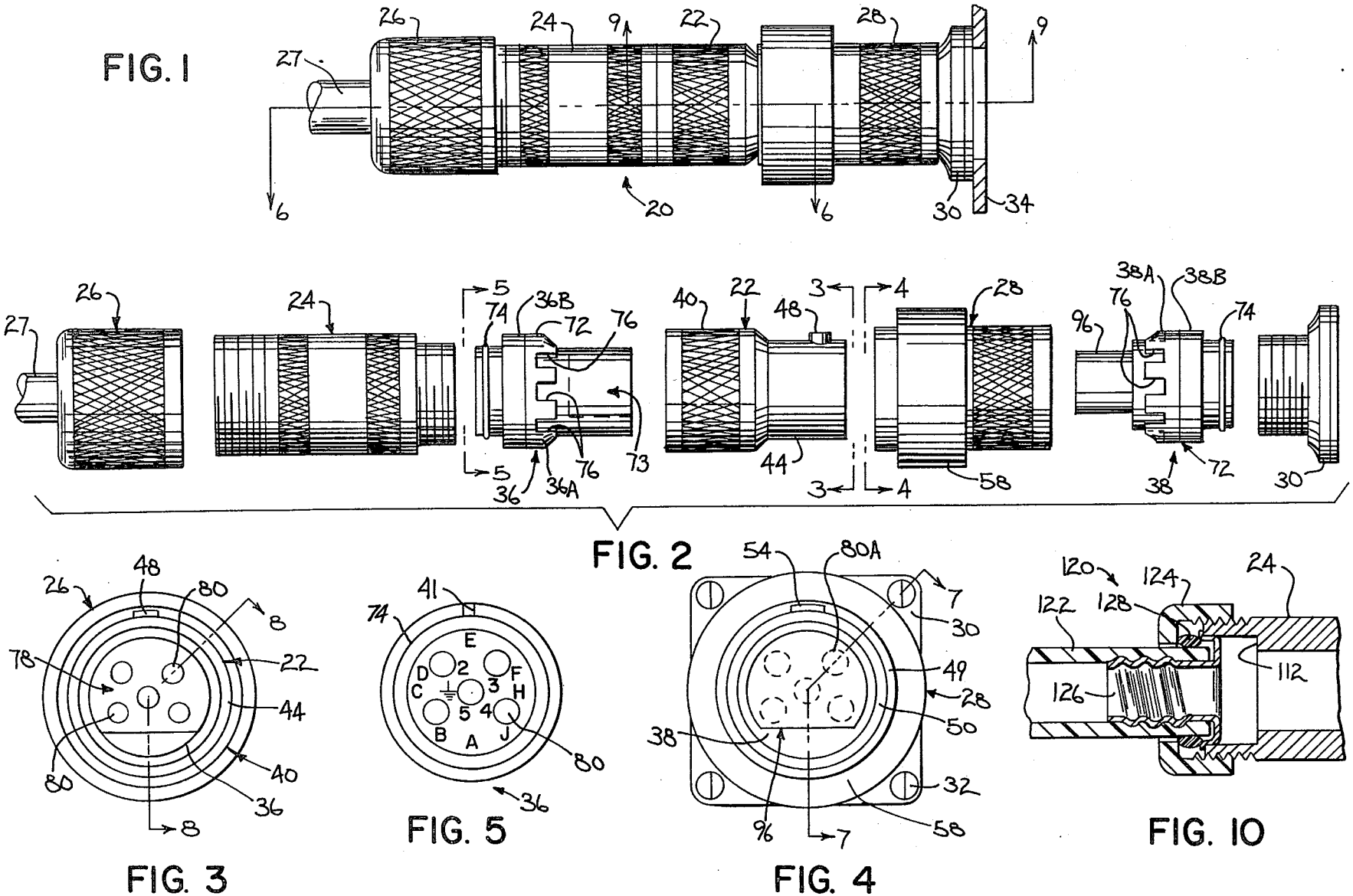
FIG. 1 is an elevation view of one embodiment of the universal electrical connector of the present invention, there depicted as a portable male plug connected to a wall-mounted, female receptacle.
FIG. 2 is an exploded assembly view of the various components of the connector of FIG. 1.
FIG. 3 is an end view of certain connector components, as viewed along lines 3—3 of FIG. 2.
FIG. 4 is an end view of certain other connector components, as viewed along lines 4—4 of FIG. 2.
FIG. 5 is an end view of an insert and the plug shell for the connector of FIG. 2, as viewed along lines 5—5 thereof.
FIG. 10 is a partial cross-sectional view of a liquid-tight conduit fitting.

Having reference to the drawings, wherein like reference numerals indicate corresponding elements, there is shown in FIG. 1 an illustration of the universal electrical connector of the present invention, generally denoted by reference numeral 20, with both connector halves shown in their mated positions. As shown assembled in FIG. 1, the universal connector 20 includes a plug shell 22 that is threadedly fastened to an elongated backshell member 24, a strain relief type of cord grip adapter 26 threaded onto the long backshell 24, a receptacle shell 28 which is detachably mated or interfitted to the plug shell 22, and a square flange mount 30 onto which the receptacle shell 28 is threaded. The flange mount 30 is fastened by appropriate fasteners 32 to a stationary panel 34, such as that of an electrical box or wall member, for example.

As seen in FIGS. 2 and 7, the universal connector 20 also comprises a two-piece male insert 36 comprising a front segment 36A and a rear segment 36B. Similarly, the universal connector 20 comprises a two-piece female insert 38 comprising a front insert segment 38A and a rear segment 38B (FIG. 8).

It will be understood by those skilled in the art that the flange mount 30 can be replaced by a suitable, well-known angled or straight pipe thread mount (neither shown), or by use of a threaded boss (not shown) formed in the panel 34 or on the end of an electrical conduit. Likewise, it will be understood that the cord grip adapter 26 can be replaced with an appropriately-sized liquid-tight conduit fitting 120 (FIG. 10) which would thread onto long backshell 24 so as to provide a moisture-proof seal about the conduit. Also, the long backshell 24 can be replaced with a shortened backshell (not shown) when appropriate. Thus, as explained in more detail later herein, the accommodation by the plug shell 22, long backshell 24, and receptacle shell 28 of such different types of mounting hardware accessories promotes the adaptation of the connector 20 to various industrial applications.

It will be further understood that the material preferably used to form the cord grip adapter 26, long backshell 24, plug shell 22, receptacle shell 28, and square flange mount 30 is a suitable metal, such as an aluminum alloy, for example, so as to protect the inserts and terminals placed therein. On the other hand, the material preferrably used to form the male and female inserts 36, 38 is a polymeric elastomer, such as those elastomer products having a durometer (Shore A) reading falling within the range of from 55 to 95 and which are known by the generic names polyurethane, polyester elastomer, and polyvinylnitrile elastomer, for example. In the preferred embodiment, the elastomer used for inserts 36, 38 was polyester elastomer with a durometer reading of 80-A.

As best seen in FIGS. 2, 3, 6, and 9, the plug shell 22 is of a hollow cylindrical shape and comprises a large diameter portion 40 having internal threads 42, and a reduced diameter portion 44. An inner key 46 is coined into the plug shell portion 40 so as to extend radially inwardly thereof (FIGS. 6 and 9), while an outwardly extending or outer key 48 is coined into the plug shell portion 44. Additionally, an angled ledge 45 is formed on the internal diameter of plug shell 22 at the juncture of portions 40 and 44. For purposes of assembling one of the inserts 36, 38 to the plug shell 22, the shell portion 40 carries a marking 41 (FIG. 5) which is in registry with the inner key 46.

Figure 9:
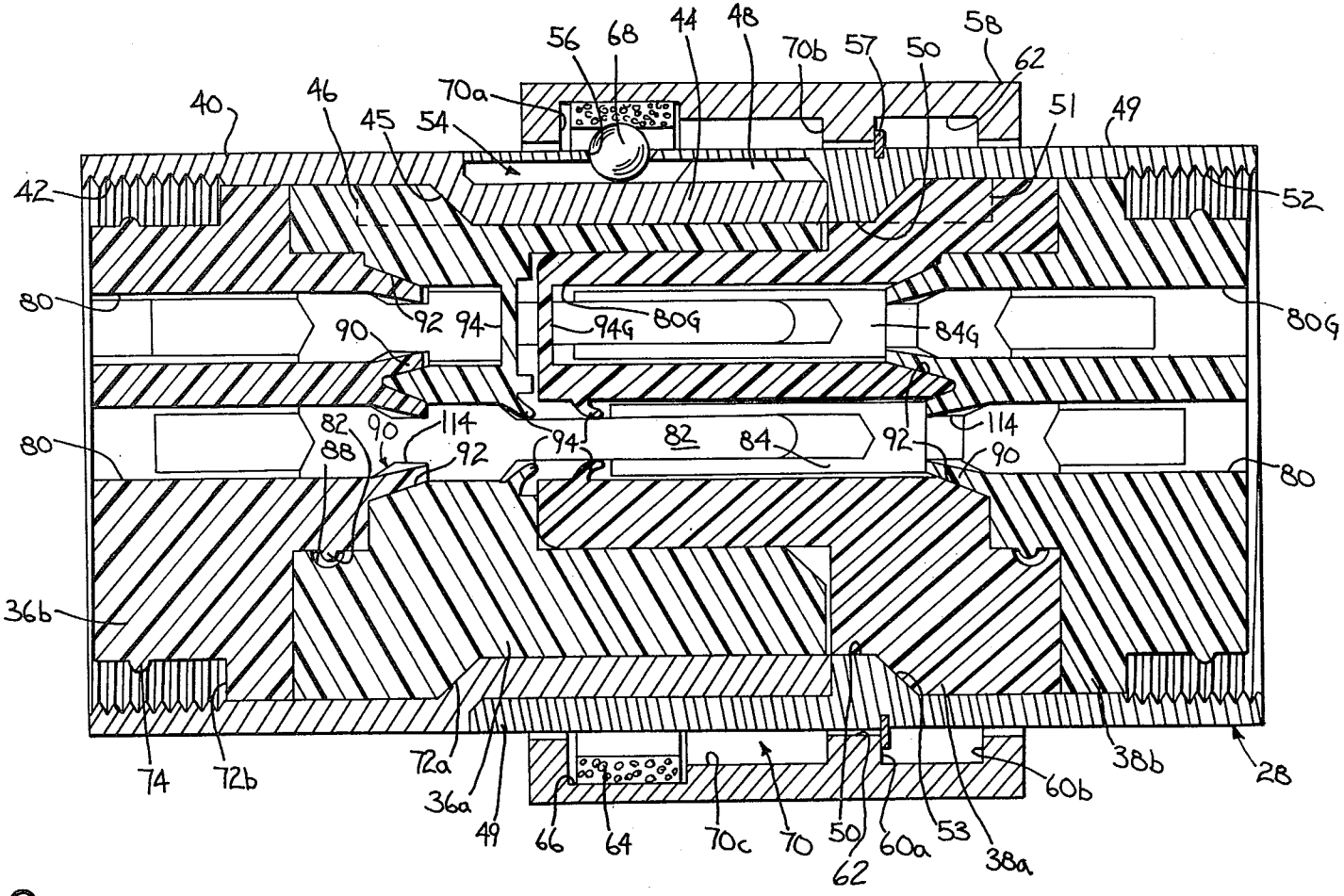
FIG. 9 is a cross sectional view of the plug shell, receptacle shell, and male and female inserts, as viewed along lines 9—9 of FIG. 1.

As best seen in FIGS. 2, 4, and 9, the receptacle shell 28 generally comprises a shell body 49 and a lock coupling 58. The shell body 49 has a hollow cylindrical shape with an inwardly-extending annular rib 50 formed on its internal diameter at the midpoint thereof, an inner key 51, and internal threads 52 formed at one end thereof. Similar in nature to ledge 45, one of the sides of the annular rib 50 is formed as an angled ledge 53. The shell body 49 also has a broached internal keyway 54 formed on its internal diameter at the end opposite the threads 52. A chamfered opening 56 is formed through the shell body 49 and communicates with the keyway 54. An outwardly extending, annular stop rib 57 is carried by the receptacle shell body 49.

The lock coupling 58 is also of a generally hollow cylindrical shape. The coupling 58 is placed over the shell body 49 such that the stop rib, 57 is contained between the sidewalls 60A, 60B of an annular groove 62 formed on the interior of coupling 58. An annular ring segment 64 formed of a cushioning material such as foam rubber, for example, is carried within another groove 66 formed on coupling 58. During assembly of the receptacle shell 28, a detent ball 68 is so placed as to ride within the chamfered opening 56 as well as to be confined between the end walls 70A, 70B of a third annular groove 70 formed on the internal diameter of coupling 58. It will be noted that, when lock coupling 58 is in the release position as shown in FIG. 9, the detent ball 68 can be moved up into the cushion ring 64 when plug shell 22, and hence its outer key 48, are moved to the left during uncoupling of connector 20. Alternatively, when the coupling 58 is in its lock position (FIG. 1), the detent ball 68 is retained within chamfered opening 56 by the outer groove wall 70*c*, whereby the detent ball 68 prevents the key 48, and hence plug shell 22, from being uncoupled from receptacle shell 28. It will be understood then that the outer key 48 on plug shell 22 and the keyway 54 on receptacle shell 28 cooperate to provide so-called mating shell keys for connector 20.

Turning to FIGS. 2, 3, 5, and 7, there is shown the elastomeric male insert 36. The male insert 36 is generally cylindrical in shape and includes an annular boss section 72 having an enlarged diameter which closely corresponds to the inside diameter of plug shell portion 40, as well as an elongated shroud portion 73. A locking detent rib 74 is formed on male insert segment 36B, the diameter of which is chosen to fit within a mating groove 75 formed on the inside diameter of the backshell 24. The rib 74 and groove 75 cooperate to prevent unintentional separation of the insert 36, and hence plug shell 22, from the backshell 24. A series of indexing keyways or slots 76 are formed on the enlarged boss section 72 of the insert half 36A; the slots 76 extend towards the end of insert 36 opposite from detent rib 74 (see FIG. 2). The width of each slot 76 closely approximates that of the key 46 formed on portion 40 so that they may be respectively engaged thereby. For purposes of selectively orienting the connector 20 when assembled, a D-shaped bore 78 is formed within the shroud 73 of male insert segment 36A (FIG. 3).

Both front and rear male insert segments 36A, 36B contain aligned terminal cavities 80 for receiving a male terminal pin 82, or alternatively a female terminal sleeve or socket 84 (see FIG. 9). Additionally, the rear segment 36B carries an annular retaining rib 86 which engages a mating groove 88 formed on the front segment 36A when the two segments 36A, 36B are assembled; this feature allows only limited separation of the two halves. Further, as seen in FIG. 7, the rear segment 36B has a conical locking ring portion 90 formed about each of the terminal cavities 80 at the right end thereof. A mating series of conical ramp surfaces 92 are formed at the left end (FIG. 7) of each of the terminal cavities 80 formed in front segment 36A.

Formed at the right end of each terminal cavity 80 in insert segment 36A (see FIG. 7) is a diaphragm member 94 which completely seals off that cavity from dust and moisture. Other purposes of the diaphrams 94 will be explained later herein. A series of markings, such as letters A through J (FIG. 5), are placed on the left end of rear insert segment 36B (FIG. 7). These letter markings respectively correspond with each of the index slots 76 formed on front insert segment 36A. Likewise, other markings, such as the numerals 1 through 5, are also formed on the left end of insert segment 36B (see FIGS. 5 and 7) and relate to each of the five terminal cavities 80 formed therein. The use of such numeral and letter markings will be explained later herein.

A two-piece female insert 38 (FIGS. 2, 4, 8, and 9) is of similar construction to and has the same outer diameter dimension as the male insert 36 of FIG. 7. The insert 38 comprises a front segment 38A and a rear segment 38B. Also, like the male insert 36, the female insert 38 includes an annular retaining rib 86 on segment 38B which mates with a groove 88 on segment 38A, a locking detent rib 74, a series of index slots 76, five terminal cavities 80, the conical locking ring portions 90, the mating conical ramp surfaces 92, a diaphragm seal 94 covering off each terminal cavity 80, and appropriate letter and numeral markings. The only substantial difference between male insert 36 and female insert 38 is that insert 38 has a D-shaped extension section 96 (FIG. 4) which can be matingly received within the D-shaped bore 78 of elongated shroud 73 of male insert 36. It is this D-shaped alignment configuration of the inserts 36, 38 that allows the halves of connector 20 to only be mated in one specific angular orientation. Additionally, it will be noted that one of the diaphragms, denoted by reference numeral 94G, is so positioned when segment 38A is formed as to make one particular terminal cavity, denoted by reference numeral 80G, longer than the remaining cavities 80, the purpose of which will be explained later herein.

It will be noted that the enlarged boss 72 for both male and female inserts 36, 38 includes an angled front edge 72A and a radially extending rear edge 72B. It will be understood that the lineal distance between surfaces 72A and 72B on the enlarged bosses 72 of each insert 36, 38 is the same once the component insert segments have been assembled together. As explained later herein, this specific feature is important in providing a watertight seal between the inserts 36, 38 and the terminals 82, 84, as well as with the shells 22, 24.

The cord grip adaptor 26 (FIG. 6) comprises a grip shell 96 having internal threads 100 and an internal ramp portion 102, a metallic plunger 104, a coiled garter spring 106 confined between the plunger 104 and ramp 102, and an elastomeric seal washer 108 having a metallic annular stiffening member 110, the seal washer being retained between the plunger 104 and an internal ledge 112 formed on the long backshell 24.

The liquid-tight conduit fitting 120 (FIG. 10) can be used as a replacement on the long backshell 24 for cord grip 26 in those situations where the terminated wires 116 are carried in a liquid-tight conduit 122 rather than the portable cord 27. The liquid-tight fitting 120 comprises an internally threaded coupling ring 124, a grip member 126, and a flexible seal member 128 compressably seated therebetween.

Turning now to the assembly and operation of connector 20 of the present invention, as seen in FIG. 9, the assembled insert segments 36A, 36B have been inserted into the plug shell 22 such that the index slot 76 corresponding with letter marking E (FIG. 5) has been rotatably indexed to and fitted about the inner key 46 of plug shell 22. In this manner, a specific mating angle or key angle (FIGS. 3 and 4) is established for connector 20. Also in this position, the angled face 72A of enlarged boss 72 of insert 36 has engaged the angled ledge 45 of plug shell 22, the retaining rib 86 has seated within the groove 88, and lastly, the detent locking rib 74 has been seated within the groove 75 of backshell 24 (FIG. 6).

A male terminal pin 82 has been fully inserted into the lower terminal cavity 80 of insert 36 (FIG. 9) whereby the pin 82 has pierced that cavity's diaphragm 94. Also, in a conventional manner, the male pin 82 is crimped onto a wire lead 116 of cord 27 (FIG. 6). Further, the assembly of backshell 24 and the plug shell 22 carrying male insert 36 has caused the conical ramp 92 of front segment 36A to compress the conical locking ring 90 of rear segment 36B inwardly, thereby causing the leading edge of locking ring 90 to seat within the undercut shank 114 of pin 82.

In like fashion, the front and rear insert segments 38A, 38B have been assembled together (FIG. 9) and inserted within the receptacle shell 28. In doing so, the female insert 38 has been properly oriented within shell 28 by rotatably indexing the former until the appropriate slot 76 has engaged the inner key 51 of receptacle shell body 49. In this position, the angled edge 72A of insert 38 has engaged the ledge 53 of shell body 49. Further, a female terminal or sleeve 84 has been inserted in the lower terminal cavity 80 of insert 38 (FIG. 9). Here also the threaded assembly of the flange mount backshell 30 with the receptacle shell 28 carrying the insert 38 has caused the ramp 92 of segment 38A to force the conical locking ring 90 of segment 38B into the undercut shank 114 of sleeve 84.

It will be understood that, when the long backshell 24 is threadedly inserted into plug shell portion 40, the leading edge 118 of backshell 24 engages against rear edge 72B of insert 36. This action tends to move and compress the enlarged insert boss 72 until its angled front edge 72A forcibly abuts plug shell ledge 45. Under such compression, the elastomeric nature of insert 36 causes the enlarged boss 72 to be radially compressed against the internal diameter of plug shell portion 40; this produces an advantageous watertight, circumferential seal therebetween. In like fashion, the threaded insertion of flange mount 30, or any similarly used backshell component such as a pipe thread mount (not shown), a threaded panel boss (not shown), or another long backshell 24, for example, acts to compress the enlarged boss 72 of female insert 38; this produces a watertight seal with receptacle shell body 49 adjacent the inner annular rib 50 thereof.

It will be further understood that, before the long backshell 24, the flange mount 30, or any of the other backshell components is threaded onto either of the shells 22, 28, the elastomeric nature of the insert locking rings 90 effect a positive retention of a terminal 82, 84 inserted therein. In this manner, the pins 82 and sleeves 84 are positionally retained and cannot be easily pushed or pulled out. Further, in such a partially assembled condition they can, in fact, be pulled back out of their respective terminal cavity 80, i.e., the associated locking ring 90 will flex outwardly allowing the undercut terminal shank 114 pass thereby.

It is only when the long backshell 24 (or other backshell component) has forcibly compressed the enlarged insert boss 72 that the locking rings 90 are firmly compressably locked about the undercut shank 114 of a terminal 82, 84. It is only when a shell 22, 28 is loaded with an insert 36, 38 and fully assembled the terminals 82, 84 are lockably retained within their respective cavities 80 and cannot be easily removed therefrom without much force. Such terminal locking system allows for easy insertion, i.e., low insertion force, in assembling a terminal 82, 84 to the inserts 36, 38, but, when fully assembled the locking components (locking ramps 90 cooperating with conical ramps 92) provide high withdrawl forces to the respective terminals. It is thus seen that terminals 82, 84 can be readily placed in the elastomeric inserts 36, 38 and easily removed if ever damaged, all without the requirement of any special terminal insertion or removal tool. Further, such compression of locking rings 90 creates another point of sealing about the base of terminals 82, 84.

It will further be seen that the insertion of a terminal 82, 84 through the diaphragm 94 of either insert 36, 38 acts to form a circumferential web seal about pin 82 out of the then broken diaphragm. Finally, when the loaded receptacle shell 28 is mated with the loaded plug shell 22 through use of the lock coupling 58 (FIG. 9), the terminal pin 82 acts to pierce another diaphragm, i.e., the diaphragm 94 in cavity 80 of the female insert 38. This second pierced diaphragm 94 also provides another web seal about the terminal pin 82, excluding films and dust; it acts to facilitate a better electrical connection and to maintain the integrity of the cavities 80 in female insert 38. Other advantages of the diaphragms 94 are that they center the male terminals 82 during insertion into female sleeves 84, thereby reducing the danger of damaging the latter, especially in rocking action while uncoupling connector 20. Further, the diaphragms act to support the mated terminals 82, 84, thereby improving shock and vibration resistance. Alternatively, the diaphragms may be pre-pierced with a simple sharp pointed tool before assembly. This procedure eliminates any potential problems in the initial mating, because of the higher than normal mating forces required to puncture the diaphragms.

Turning to FIGS. 1 and 6, the threading of cord grip shell 96 onto the left end of long backshell 24 causes two things to occur. First, the plunger 104 causes garter spring 106 to begin to compress as it moves up the ramp 102 from the solid line position (FIG. 6) to its dotted position, thereby firmly gripping cord 27. Additionally, the pressure thereby created on plunger 104 causes it to compress the seal washer 108 against internal edge 112 of long backshell 24. This action radially compresses washer 108 about cord 27 and effects an additional watertight seal for connector 20. The garter spring type of cord grip 26 will accommodate a broad range of cord diameters while still providing an excellent holding ability without damaging the exterior of the cord.

Due to the fact that the inserts 36, 38 can be rotatably indexed to the desired position via slots 76 and keys 46, 51 thereby allowing the user to select a desired orientation for the mating of the D-shaped insert components, a minimum number of connector components can be utilized to custom assemble a wide variety of industrial connectors. Further, the use of an antivibration locking system (locking rib 74 and groove 75) acts to prevent any unwanted unthreading of the associated backshell component from the shells 22, 28. Also, through use of two separate segments for each of the elastomeric inserts 36, 38, the compression of such inserts causes their locking components (rings 90 and ramps 92) to compressably lock and retain the respective terminals 82, 84.

Flexibility through modularized components of the present connector is provided inasmuch as both the male insert 36 and female insert 38 can be interchangeably used with either of the shells 22, 28. Additionally, both the plug shell 22 and receptacle shell 28 can be used with either the long backshell 24, the flange mount 30, or other types of backshell components described herein. Moreover, both the inserts 36, 38 can receive either a terminal pin 82 or a terminal sleeve 84. Also, only one uniform exterior diameter is used for both the male and female inserts, regardless of the number of circuits or specific backshell component utilized. Further, the fact that the diaphragms are not opened until intentionally pierced when the specific application is known allows the connector 22 to be used for from one circuit up to several circuits, all without comprising the integrity of the remaining unused diaphragms and cavities, and hence the entire connector 20. Lastly, the provision in the female insert 38 of a terminal cavity 80G that allows the terminal 84G inserted therein to extend farther thereinto assures that, in mating, a ground wire used with that terminal will make electrical contact before the other live circuits, all without the need for special grounding apparatus or special terminals.

From the foregoing, it is believed that those skilled in the art will readily appreciate the unique features and advantages of the present invention over previous types of electrical connectors. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

I claim:

1. An environmentally sealed, hand assemblable, electrical connector of the pin and sleeve type including a pair of hollow interfittable angularly oriented shell members, a pair of resilient insert members coaxially and interchangably received within either of the shell members and having aligned terminal receiving cavities therein and index means allowing selective mounting of each insert member into its respective shell member in one of a plurality of mating orientations, two sets of elongated mateable terminals, each set being mounted in the cavities of one of the insert members, terminal locking means operable to lock said terminals in said cavities, and backshell means matingly received by one of said shell members which cooperates therewith for compressing said insert member in order to create an environmental seal between said shell member and said insert member, the improvement comprising:

each insert member having a modular construction and including two mating segments with aligned openings to define each cavity, one of the segments having an extension portion nestably receivable within axecess in the other segment for forming an environmental seal therebetween, interengaging means cooperable and formed at the nestably related juncture of the segments for maintaining the segments in mating relationship by blocking separation thereof in the axial direction of said openings, and at least one of the segments having a rupturable diaphragm member formed across each of the terminal cavities, to provide sealing engagement with terminals inserted into the cavities, said openings of said one segment passing through said extension portion.

2. The invention of claim 1, wherein said terminal locking means comprises locking ring means integrally formed on one of said mating insert segments and mating locking ramp means formed on the other of said mating insert segments, whereby compression of a said insert member against a said shell member by said backshell means causes said locking ramp means to lockably engage said locking ring means against a terminal placed therein and to form environmental seals between both the mating segments and the terminals.

3. The invention of claim 1, and groove means formed on said backshell means, and rib means formed on each said mating insert member, whereby when said backshell means is mated with a said shell member carrying a said insert member, said groove means and said rib means cooperate to prevent any unwanted uncoupling due to vibration.

4. The invention of claim 1, and cord grip apparatus characterized as operable to be threadably coupled with said backshell means, said cord grip apparatus comprising a grip shell means having an internal ramp formed thereon, an annular spring member, an annular seal member, and plunger means, whereby threaded coupling of said cord grip apparatus onto said backshell means causes said plunger means to force said annular spring member along said internal ramp so as to be radially compressed thereby lockably gripping a cord member placed therethrough, and further causes said annular seal member to be compressed between the backshell and plunger thereby sealingly engaging a cord member place therethrough.

5. The invention of claim 1, and key means formed on one of said shell members, and mating coupling means carried by said other shell member, said coupling means comprising an annular coupler ring slidably retained about said other shell member, groove means formed on said annular coupler ring and characterized as carrying resilient means therein, and a detent ball carried between said annular coupler ring and a chamfered opening formed in said other shell member, said detent ball operable to lockably retain said key means of said one shell member when said mating coupling means is in a first slideable position, said detent ball being further operable to release said key means when said mating coupling means is in a second slideable position whereat said detent ball is deflectable by said key means into said resilient means carried by said coupler ring.

* * * * *